US012747600B2

(12) United States Patent
Gonzalez

(10) Patent No.: US 12,747,600 B2
(45) Date of Patent: Sep. 29, 2026

(54) COLD PLUNGE SYSTEM WITH QUICK RELEASE HOSE-ARM

(71) Applicant: Christopher Gonzalez, San Francisco, CA (US)

(72) Inventor: Christopher Gonzalez, San Francisco, CA (US)

( * ) Notice: Subject to any disclaimer, the term of this patent is extended or adjusted under 35 U.S.C. 154(b) by 65 days.

(21) Appl. No.: 18/776,722

(22) Filed: Jul. 18, 2024

(65) Prior Publication Data

US 2026/0022580 A1 Jan. 22, 2026

Related U.S. Application Data

(60) Provisional application No. 63/611,116, filed on Dec. 16, 2023.

(51) Int. Cl.
*E04H 4/12* (2006.01)

(52) U.S. Cl.
CPC ..... *E04H 4/1209* (2013.01)

(58) Field of Classification Search
CPC ..... E04H 4/1209
See application file for complete search history.

(56) References Cited

U.S. PATENT DOCUMENTS

| | | | | |
|---|---|---|---|---|
| 12,161,602 | B1 * | 12/2024 | Fougnies | A61H 33/0095 |
| 12,203,699 | B2 * | 1/2025 | Mudd | F25D 31/002 |
| 12,447,100 | B2 * | 10/2025 | Hanson | A61H 33/6005 |
| 2020/0289361 | A1 * | 9/2020 | Tian | A61H 9/0092 |
| 2023/0233367 | A1 * | 7/2023 | Hwang | A61F 7/007 607/104 |

* cited by examiner

*Primary Examiner* — Christine J Skubinna
(74) *Attorney, Agent, or Firm* — Imperium Patent Works LLP; Mark D. Marrello

(57) ABSTRACT

A cold plunge system designed for home use, incorporating a water cooling device and an innovative quick release hose-arm. The water cooling device includes a heat exchanger, compressor, fan, water reservoir, filter, self-priming diaphragm pump, and a hose-arm connecting receptacle. The hose-arm, essential for transferring water between an external reservoir and the cooling device, consists of insulated water tubes, a bend-and-stay object like a Loc-Line tension arm, and a quick connect terminal. Insulation materials for the tubes include neoprene and foam. The system features a hose-arm enclosure made of plastic, possibly with a perforated, stretchable outer sleeve of nylon fabric. Designed to work with common household bathtubs, this system is controlled by a circuit with a processor and memory, interfacing with temperature sensors, user input devices, and a touchscreen display. It also supports remote communication, enhancing user convenience and control.

22 Claims, 12 Drawing Sheets

HOMEPLUNGE SYSTEM

HOMEPLUNGE SYSTEM

QUICK RELEASE HOSE-ARM CONNECTION

QUICK RELEASE HOSE-ARM BUTTON

HOMEPLUNGE SYSTEM

HOMEPLUNGE SYSTEM

HOMEPLUNGE SYSTEM

QUICK RELEASE HOSE-ARM

LOC-LINE TENSION ARM
(BEND AND STAY OBJECT)

QUICK RELEASE HOSE-ARM
INSULATION LAYER & LOC-LINE STRUCTURE

CHILLER SYSTEM

ELECTRONIC CONTROL SYSTEM

COLD PLUNGE SYSTEM WITH QUICK RELEASE HOSE-ARM

CROSS REFERENCE TO RELATED APPLICATIONS

This application claims priority under 35 U.S.C. § 119 from U.S. Provisional Application No. 63/611,116, entitled "COLD PLUNGE SYSTEM", filed on Dec. 16, 2023, the subject matter of which is incorporated herein by reference.

TECHNICAL FIELD

The present invention generally relates to systems and methods for cold plunge baths. More specifically, the present invention relates new systems and methods for achieving a cold plunge bath for home use.

BACKGROUND INFORMATION

The history of cold plunge equipment traces back centuries, with roots in ancient civilizations where cold water immersion was used for therapeutic and religious purposes. The evolution of cold plunge equipment reflects advances in technology, an increasing understanding of the health benefits of cold therapy and shifts in cultural practices.

The Greeks were among the first to incorporate cold plunges into their bathing rituals. Cold water immersion was part of the regimen in gymnasia and public baths, believed to aid in recovery and invigorate the body. Then, the Romans further developed public bathing, constructing elaborate bathhouses (thermae) that included cold plunge pools (frigidarium). These pools were integral to the bathing process, following hot baths (caldarium) to close the pores and refresh the bather.

The decline of the Roman Empire saw a reduction in the popularity of public baths, but cold water immersion persisted in monastic practices. Monks often used cold baths for their purported health benefits and as a form of penance. Then, during the Renaissance, there was a renewed interest in the classical practices of ancient Greece and Rome. Cold bathing saw a resurgence, often advocated by physicians for its health benefits.

The 18th century saw the rise of hydrotherapy, with cold water treatments becoming popular in Europe. Figures like Vincenz Priessnitz and Sebastian Kneipp promoted cold water therapy as part of natural healing methods.

Early cold plunge equipment was rudimentary, often involving simple wooden tubs or natural water sources. However, specialized equipment began to emerge, including dedicated plunge pools in health spas and sanatoriums. However, in recent history, cold plunge technology has moved forward. The 20th century brought significant advancements in the design and manufacture of cold plunge equipment. Materials like stainless steel and fiberglass replaced wood, offering more durable and hygienic options.

In the present day, cold plunge pools have become more accessible, with installations in private homes, gyms, and athletic facilities. The increasing popularity of sports science highlighted the benefits of cold therapy for muscle recovery, leading to widespread use among athletes. Even further, the advent of cryotherapy has emerged, where cold plunge was taken to the next level with cryo chambers that used liquid nitrogen to achieve extremely low temperatures for short bursts.

Today's cold plunge equipment ranges from high-tech cryotherapy chambers to sleek, temperature-controlled plunge pools.

The modern wellness movement has further popularized cold plunging. Influencers and health enthusiasts advocate for cold therapy's benefits, including improved circulation, reduced inflammation, and enhanced mental clarity.

Modern cold plunge equipment is designed to be more user-friendly and customizable, catering to individual preferences for temperature and duration. Portable and inflatable models have also made cold plunging more accessible to a broader audience.

From ancient Greek baths to modern cryotherapy chambers, cold plunge equipment has evolved significantly over the centuries. The progression reflects a growing understanding of the therapeutic benefits of cold immersion and advances in technology that have made cold therapy more effective, accessible, and widely adopted. Today, cold plunge equipment is a common feature in both athletic and wellness contexts, continuing a tradition that spans millennia.

While the above mentioned evolution has greatly improved cold plunge technology, there is a need for a new and improved cold plunge system designed for home use.

SUMMARY

In a first novel aspect, a cold plunge system is designed for home use, incorporating a water cooling device and an innovative quick release hose-arm. The water cooling device includes a heat exchanger, compressor, fan, water reservoir, filter, self-priming diaphragm pump, and a hose-arm connecting receptacle.

In a second novel aspect, the hose-arm, essential for transferring water between an external reservoir and the cooling device, consists of insulated PVC water hoses, a bend-and-stay object like a Loc-Line tension arm, and a quick connect terminal. Insulation materials for the hoses include neoprene and foam. The system features a hose-arm enclosure made of plastic, possibly with a perforated, stretchable outer sleeve of nylon fabric.

In a third novel aspect, the cold plunge system is designed to work with common household bathtubs. This system is controlled by a circuit with a processor and memory, interfacing with temperature sensors, user input devices, and a touchscreen display. It also supports remote communication, enhancing user convenience and control.

Further details and embodiments and techniques are described in the detailed description below. This summary does not purport to define the invention. The invention is defined by the claims.

BRIEF DESCRIPTION OF THE DRAWINGS

The accompanying drawings, where like numerals indicate like components, illustrate embodiments of the invention.

DETAILED DESCRIPTION

Figure 1:
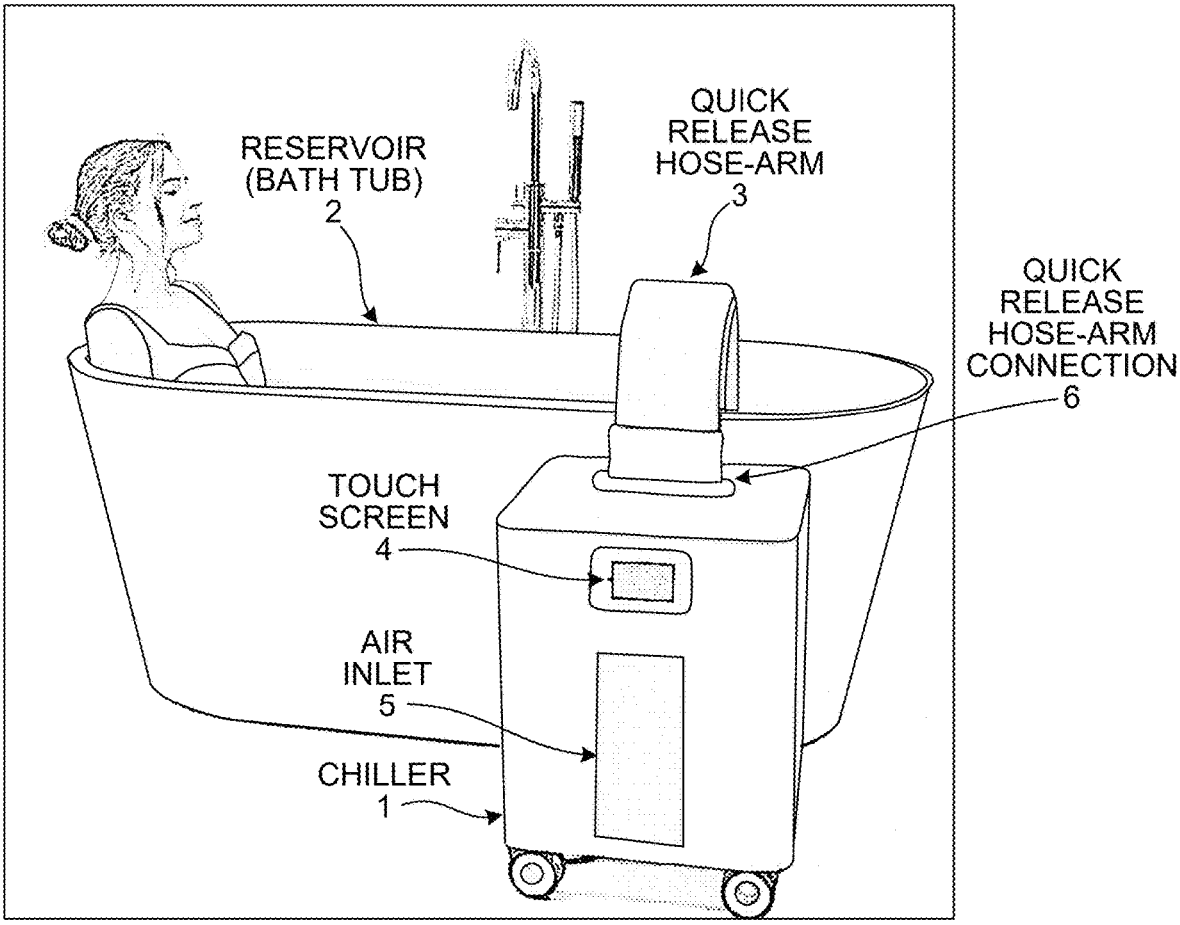
FIG. 1 is a diagram illustrating a new home plunge system.

Reference will now be made in detail to background examples and some embodiments of the invention, examples of which are illustrated in the accompanying drawings. In the description and claims below, relational terms such as "top", "down", "upper", "lower", "top", "bottom", "left" and "right" may be used to describe relative orientations between different parts of a structure being described, and it is to be understood that the overall structure being described can actually be oriented in any way in three-dimensional space.

In today's fast-paced and often stressful world, a cold plunge solution for home use has become a highly sought-after addition to personal wellness routines. The increasing awareness of the numerous health benefits associated with cold water immersion, including improved circulation, enhanced recovery after exercise, reduced inflammation, and boosted mental clarity, underscores its relevance. With people striving to optimize their health and wellness amidst their busy schedules, the convenience of having a cold plunge at home offers an accessible and effective way to incorporate this practice into daily life. Moreover, as the popularity of holistic and natural health practices grows, a home cold plunge solution caters to the desire for self-care that is both efficient and impactful. This demand is further amplified by the current emphasis on reducing trips to crowded public facilities, thus enhancing personal hygiene and safety. Therefore, introducing a cold plunge solution for home use meets a critical need in today's marketplace, offering a practical, beneficial, and convenient wellness option that aligns perfectly with contemporary lifestyle trends.

Currently available cold plunge solutions often fall short in catering to the needs of home users due to several significant limitations. Many existing options are designed for commercial settings, such as spas and gyms, making them bulky, expensive, and difficult to install in a typical residential environment. These models usually require substantial space, specialized plumbing, and professional maintenance, all of which are impractical for the average homeowner. Additionally, their high cost makes them inaccessible to a broad range of consumers who could benefit from regular cold water immersion. Even smaller, portable options frequently lack the necessary durability and temperature control, leading to suboptimal user experiences. Furthermore, the aesthetics of many current cold plunge solutions do not blend well with home décor, making them an eyesore rather than an appealing addition to a living space. These factors collectively highlight a clear gap in the market for a home-friendly cold plunge solution that is compact, affordable, easy to maintain, and aesthetically pleasing, thereby making the health benefits of cold water therapy accessible to a wider audience. A home-friendly cold plunge solution that is compact, affordable, easy to maintain, and aesthetically pleasing is needed in the current marketplace.

FIG. 1 illustrates a new home plunge system. The home plunge system is a thoughtfully designed setup that brings the benefits of cold water immersion therapy right into the comfort of your home. Central to this system is the chiller 1, a state-of-the-art water cooling device engineered to deliver precise and consistent water temperatures. The chiller features an air inlet 5 for efficient cooling, a user-friendly touch screen 4 for easy temperature and timer adjustments, and a quick release hose-arm connection 6 for seamless integration with the rest of the system. Caster wheels are incorporated into the base of the chiller, providing effortless maneuverability, allowing you to easily position it wherever it is most convenient.

The quick release hose-arm 3 is an innovative component designed for maximum convenience and efficiency. It includes a quick release button that allows for rapid attachment and detachment, ensuring a secure and leak-proof connection every time. The hose-arm is equipped with both a water inlet tube and a water outlet tube, facilitating smooth water flow between the chiller and the reservoir. The chiller to hose-arm connector is designed for easy installation, allowing users to quickly set up or break down the system as needed.

Completing the home plunge system is the reservoir, which can be a bathtub or any other suitable water container. This reservoir serves as the immersion area, providing a comfortable and spacious environment for users to enjoy the therapeutic effects of cold water immersion. The entire system is designed with user convenience and home integration in mind, ensuring that you can easily incorporate cold plunge therapy into your daily routine without the need for complex installations or high maintenance.

This home plunge system offers a comprehensive solution for those seeking the health benefits of cold water therapy, combining advanced technology, user-friendly features, and practical design elements to create an accessible and effective home wellness tool.

Figure 2:
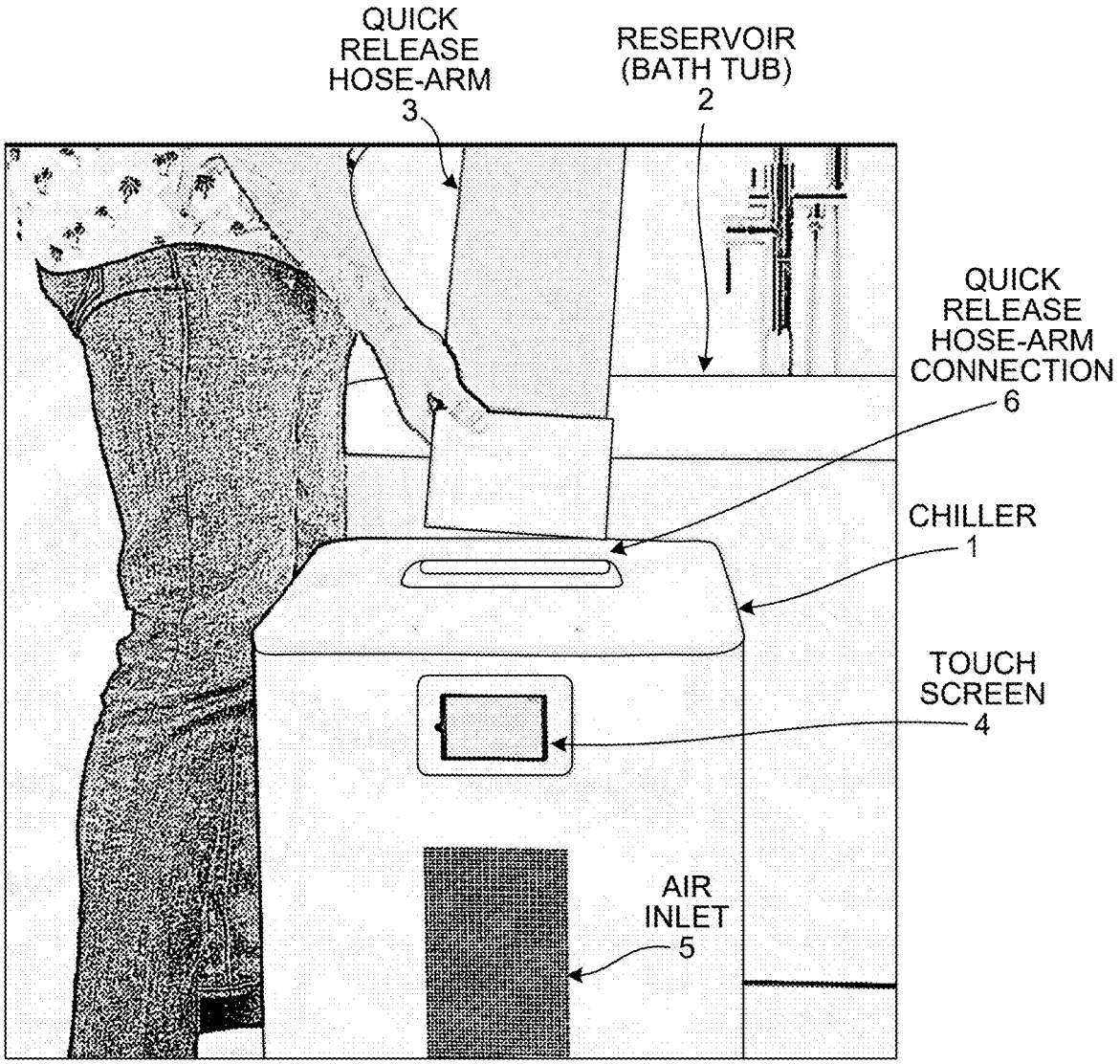
FIG. 2 is a diagram illustrating the connecting and disconnecting of the quick release hose-arm from the chiller.

FIG. 2 illustrates the connecting or disconnecting of the quick release hose-arm from the chiller. Connecting or disconnecting the hose-arm 3 from the chiller 1 is a straightforward process designed to be user-friendly and efficient, ensuring that setting up and breaking down the home plunge system is as seamless as possible.

Preparing the Hose-Arm to the Chiller Connection for Use:

Position the Chiller: Start by placing the chiller in a convenient location near your reservoir (e.g., bathtub). Ensure the chiller is on a flat surface and that the caster wheels are locked to prevent movement during setup.

Prepare the Hose-Arm: Take the quick release hose-arm and inspect the water inlet tube, water outlet tube, and the chiller to hose-arm connector to ensure they are clean and free from obstructions.

Align the Connector: Position the chiller to hose-arm connector in line with the quick release connection point on the chiller. The connector is designed to only fit one way, preventing incorrect attachments.

Attach the Hose-Arm: Insert the chiller to hose-arm connector into the corresponding port on the chiller. A clicking sound indicates that the connector is securely in place. This click is the quick release mechanism engaging, ensuring a firm and leak-proof connection.

Secure the Connection: Give the hose-arm a gentle tug to confirm that it is securely attached and will not detach during operation. Double-check that both the water inlet and outlet tubes are firmly connected.

Connect the Power Cord: Connect the chiller power cord to a local power outlet to energize the chiller.

Turn On the Chiller: Once everything is connected, power on the chiller using the user touch screen, set your desired temperature, and allow the system to cool the water. Water will circulate through the hose-arm, cooling efficiently before entering the reservoir.

Disconnecting the Hose-Arm from the Chiller After Use:

Turn Off the Chiller: Begin by turning off the chiller using the user touch screen. Ensure the system is completely powered down to prevent any water flow during disconnection.

Release Pressure: Allow any residual water pressure to dissipate by waiting a few moments after powering down the chiller. This step helps to avoid any splashing or leaking during disconnection.

Figure 3:
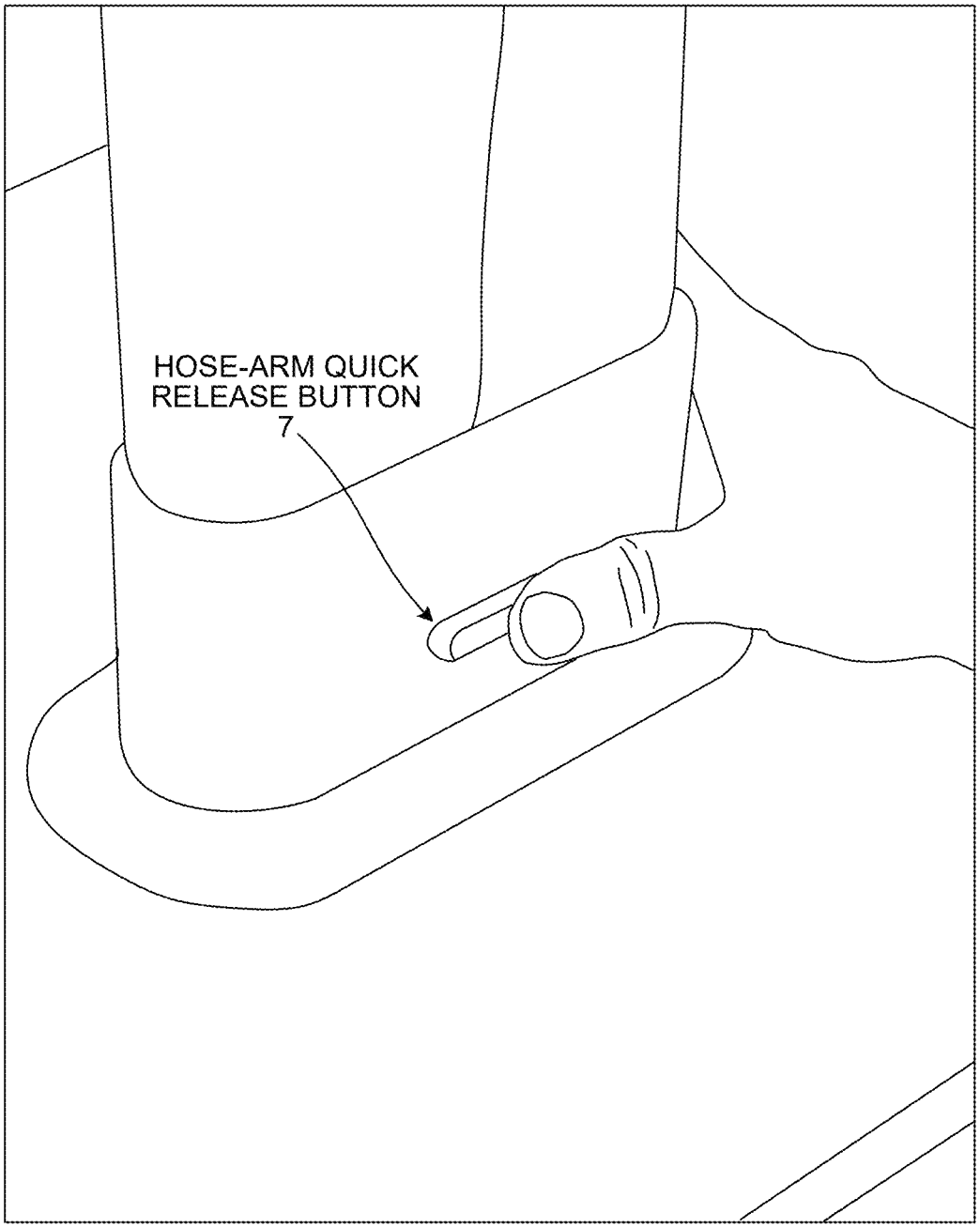
FIG. 3 is a diagram of the quick release hose-arm button.

Press the Quick Release Button: Locate the quick release button on the hose-arm connector. An example of the quick release hose-arm button is illustrated in FIG. 3. This button is designed to disengage the locking mechanism that secures the hose-arm to the chiller.

Detach the Hose-Arm: Press and hold the quick release button while gently pulling the hose-arm away from the chiller. The connector should slide out smoothly, releasing the hose-arm from the chiller.

Drain Remaining Water: Hold the hose-arm over the reservoir to allow any remaining water in the tubes to drain out. This step ensures there is no excess water left in the system, preventing spills or drips.

Store the Hose-Arm: After disconnection, store the hose-arm in a safe, dry place to prevent damage and keep it clean for future use. If the chiller has caster wheels, you can easily move it to a storage area or leave it in place if it is in a permanent location.

By following these steps, users can easily connect and disconnect the hose-arm from the chiller, ensuring a hassle-free setup and teardown process for their home plunge system. This design prioritizes user convenience and system integrity, making cold water immersion therapy accessible and straightforward.

Figure 4:
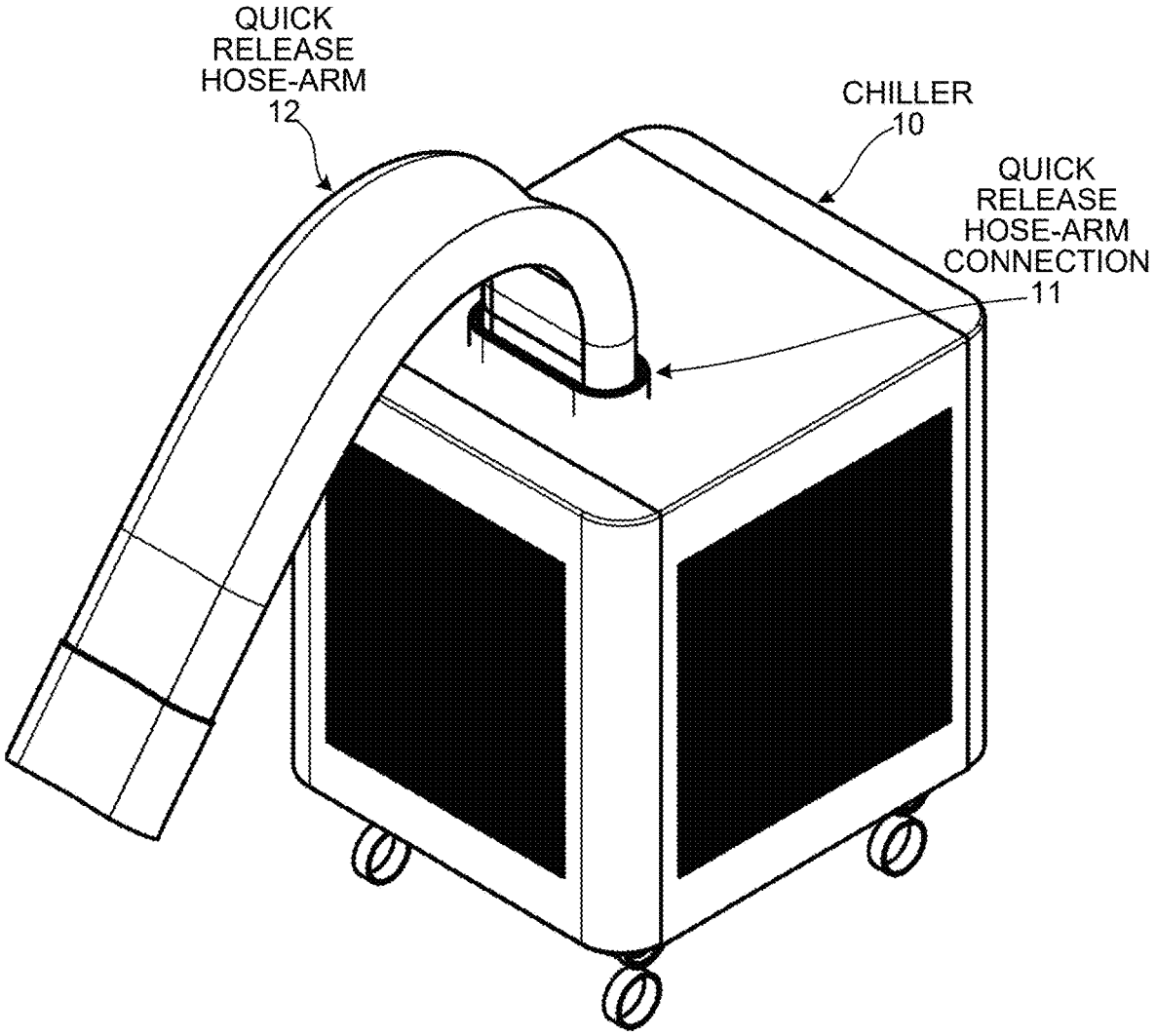
FIG. 4 is a diagram of the home plunge system when not connected to a reservoir.

FIG. 4 is another illustration of the home plunge system with the quick release hose-arm 12 connected to the chiller 10 via quick release hose-arm connection 11.

Figure 5:
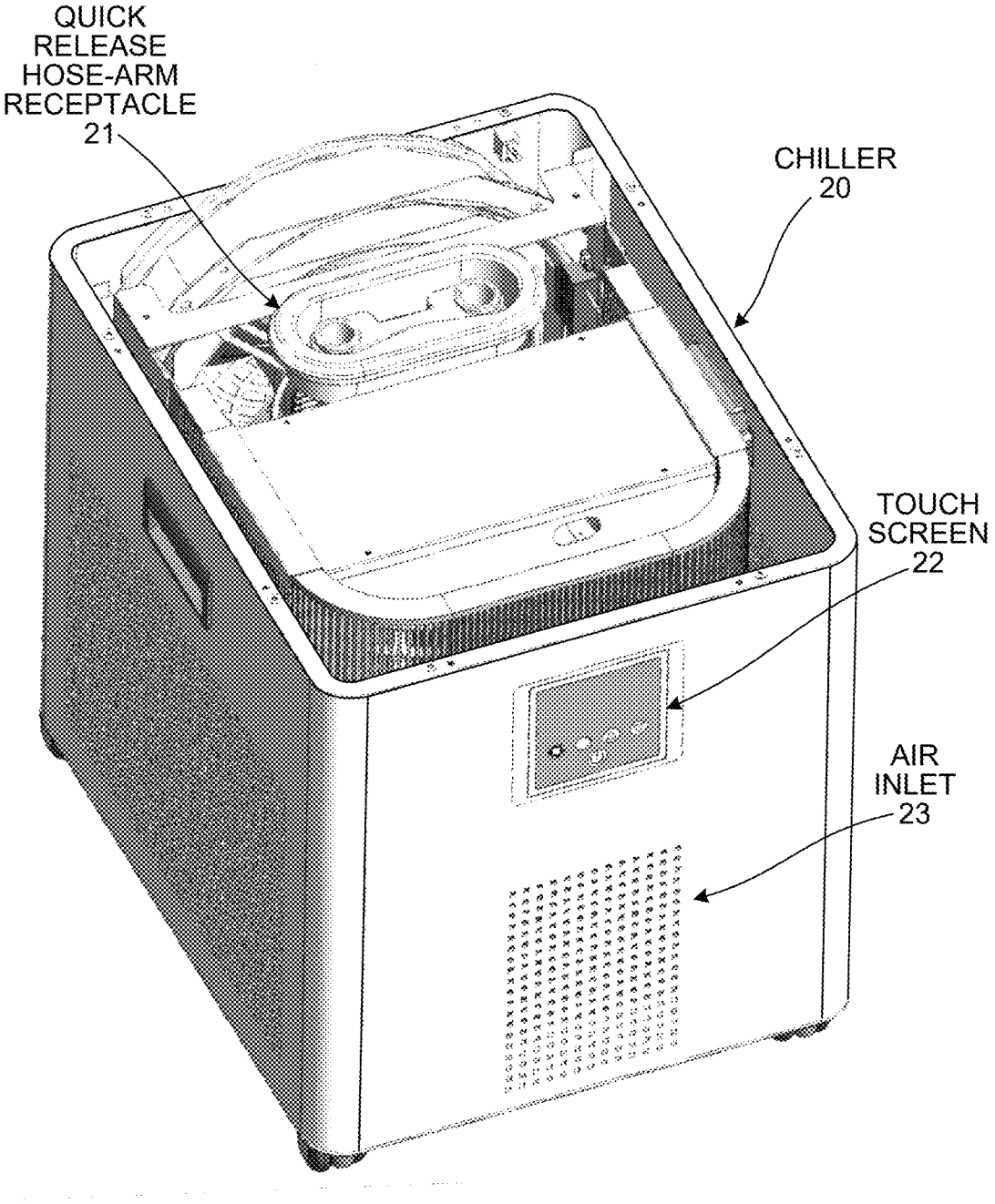
FIG. 5 is a front view three dimensional diagram of the chiller.

FIG. 5 is a three dimensional illustration front view of the chiller 20 demonstrating the internal components of the chiller 20 and an exemplary design of the quick release hose-arm receptacle 21.

Figure 6:
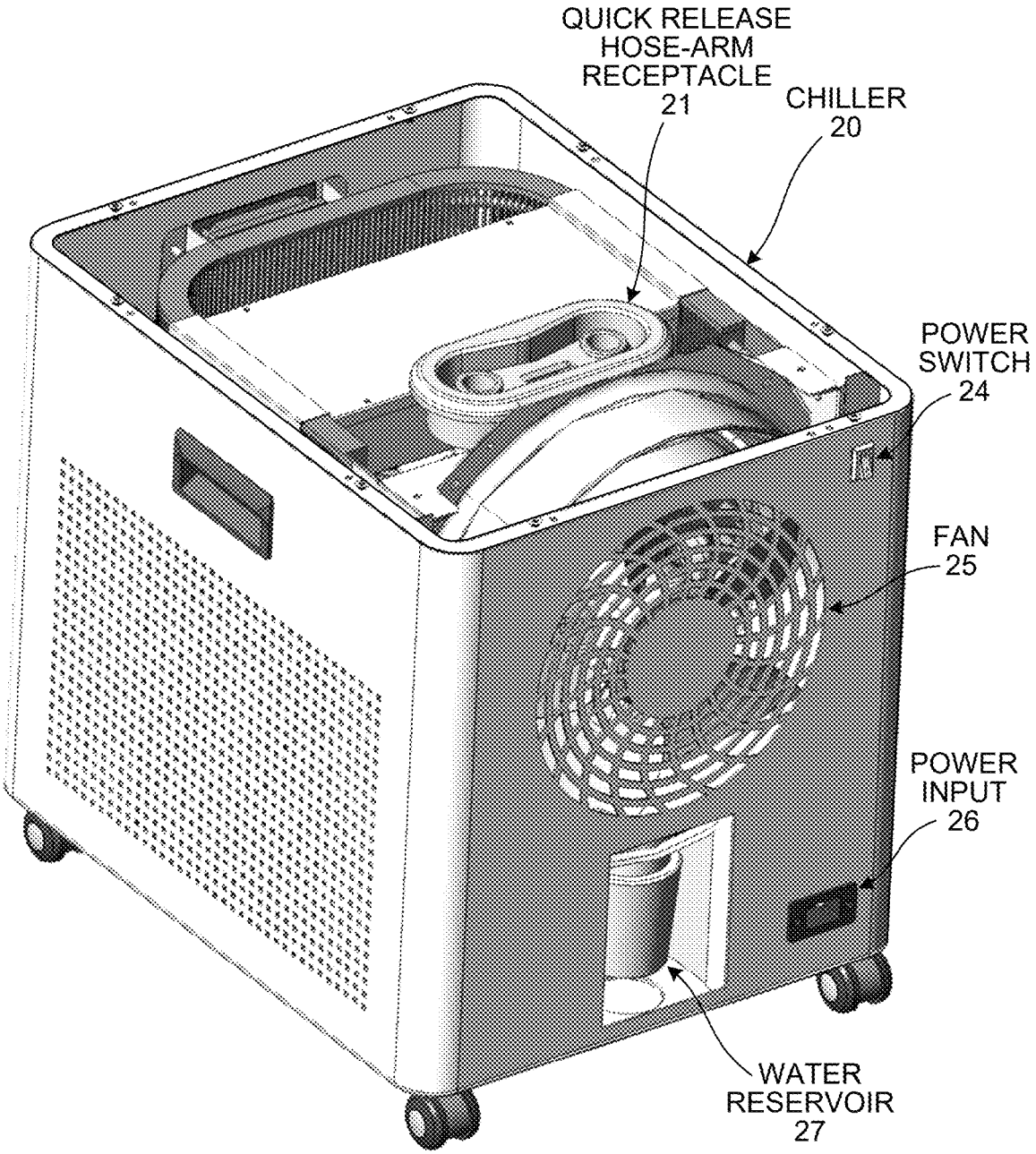
FIG. 6 is a rear view three dimensional diagram of the chiller.

FIG. 6 is a three dimensional illustration rear view of the chiller 20 demonstrating the internal components of the chiller 20 and an exemplary design of the quick release hose-arm receptacle 21, power switch 24, fan 25, power input 26, and water reservoir 27. Although not illustrated, the chiller 20 also includes a heat exchanger, a compressor, a filter, and a self-priming diaphragm pump.

Figure 7:
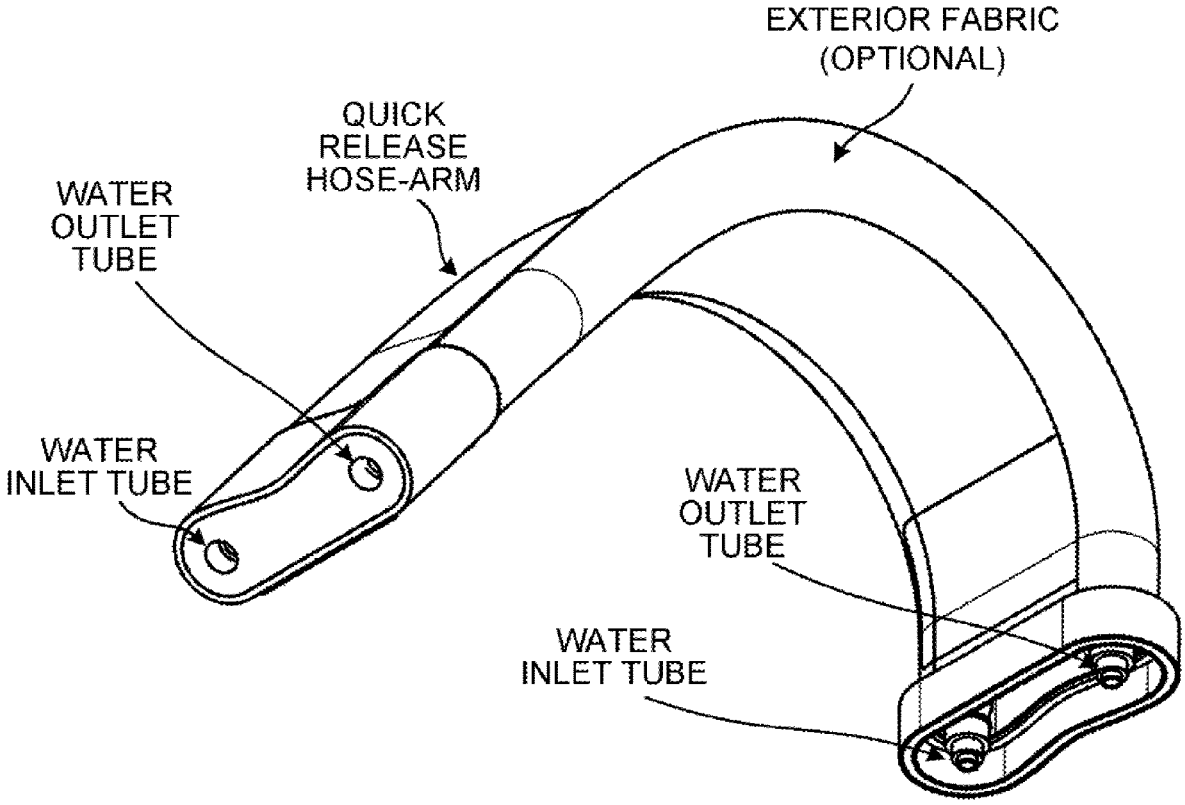
FIG. 7 is a diagram of the quick release hose-arm when not connected to a chiller or a reservoir.

FIG. 7 is an illustration of a quick release hose-arm when disconnected. The quick release hose-arm includes a first insulated water tube (or "water hose"), a second insulated water tube, a bend and stay object maintaining the shape of the hose-arm, and a hose-arm connecting terminal configured to connect a first end of the hose-arm to the hose-arm connecting receptacle. In one example, the first water tube and second water tube are constructed using PVC piping. The first water tube is configured to transport water from the reservoir to the chiller (water cooling device). The second water tube is configured to transport chilled water from the chiller to the reservoir. To protect the quick release hose-arm and surrounding surfaces, the quick release hose-arm may be wrapped in an outer sleeve. The outer sleeve may be perforated. The outer sleeve is made from a nylon fabric in one example.

Figure 8:
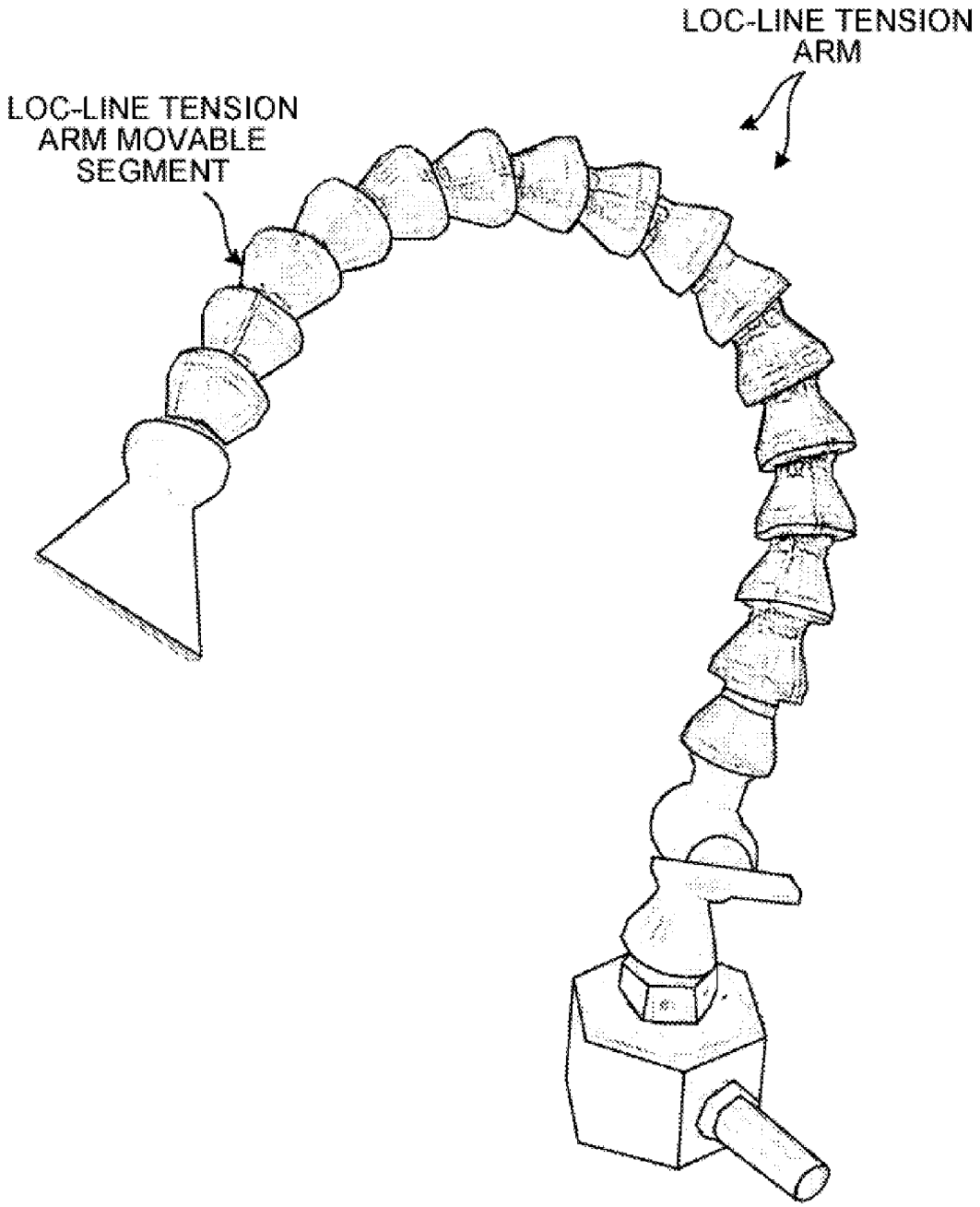
FIG. 8 is a diagram of a bend and stay object.

FIG. 8 is an example of a bend and stay object. The bend and stay object illustrated in FIG. 8 is a loc-line tension arm. A loc-line tension arm operation is based on a series of interlocking ball-and-socket joints, which provide both flexibility and rigidity. The primary components of a Loc-Line tension arm are the ball-and-socket joints. Each segment of the arm is a ball that fits snugly into a socket, allowing for a high degree of flexibility. The joints can bend, twist, and rotate, providing a wide range of motion. The arm is composed of multiple modular segments that can be added or removed as needed. These segments snap together easily, allowing users to customize the length and configuration of the arm. The tension in a Loc-Line arm is achieved through the friction between the ball and socket joints. This friction can be adjusted by changing the tightness of the joints, allowing the arm to hold its position firmly when set. The base of the Loc-Line tension arm can be equipped with various mounting options, such as clamps, magnetic bases, or threaded mounts, depending on the application. This allows the arm to be securely attached to a surface or device.

To position the Loc-Line tension arm, simply bend and twist the segments to the desired shape. The flexibility of the ball-and-socket joints allows the arm to move in almost any direction, making it highly adaptable. The tension of the arm is controlled by the friction between the joints. To adjust the tension, you can either add or remove segments or use specialized tools designed to tighten or loosen the joints. In some advanced systems, tension adjustment knobs or screws are available to fine-tune the arm's rigidity. Depending on the application, the end of the Loc-Line tension arm can be equipped with various attachments, such as nozzles, clamps, or holders. These attachments allow the arm to securely hold objects in place. For example, in a machining setup, the arm might hold a coolant nozzle, directing fluid precisely where needed. To reposition the arm, simply apply pressure to bend the segments into the new configuration. The arm will maintain its position due to the tension in the joints, providing a stable and reliable hold. One of the key advantages of the Loc-Line system is its modular nature. The arm can be easily disassembled for cleaning, maintenance, or customization. Segments can be added or removed to change the length or create different configurations.

Figure 9:
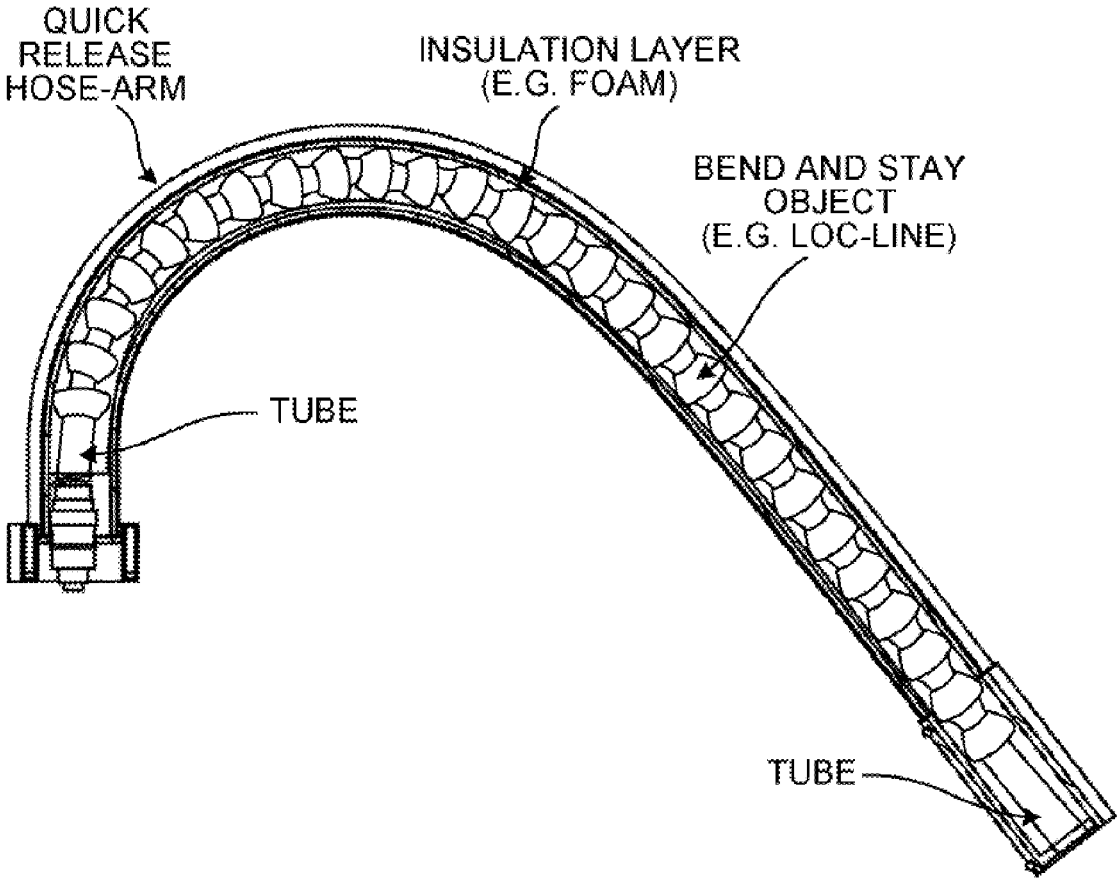
FIG. 9 is a diagram of an insulation layer within the quick release hose-arm.

FIG. 9 illustrates an insulation layer included in the quick release hose-arm. As described above, the quick release hose-arm includes two tubes configured to transport water from and to the reservoir. To maximize efficiency, both tubes may be insulated. In one embodiment, illustrated in FIG. 9, the one or more tubes in the hose-arm pass through a bend and stay object (e.g. a loc-line device). In another embodiment, the bend and stay object may be a PVC pipe coil, a bend and stay wire, a bend and stay tubing, a pipe bending spring, a PVC pipe insulation foam, a bend and stay stainless steel tube, or a rubber insulation.

Insulating a water tube is crucial for maintaining the desired temperature of the water and preventing energy loss. Various materials and methods can be used for this purpose, each with specific properties and applications.

Foam rubber, also known as elastomeric foam, is a flexible material with a closed-cell structure that offers good thermal insulation and moisture resistance. It is ideal for both hot and cold water pipes and is commonly used in HVAC systems and refrigeration. Foam rubber insulation is available in pre-slit tubes that can be easily fitted over pipes and sealed with adhesive or tape.

Fiberglass is another excellent insulating material, known for its thermal insulation properties, non-combustibility, and high-temperature resistance. It is used for both hot and cold water pipes, especially in industrial and commercial settings. Fiberglass insulation comes in pre-formed tubular sections or as blanket insulation wrapped around the pipes, often including a vapor barrier to prevent moisture buildup.

Polyethylene foam is a lightweight and flexible material with a closed-cell structure that provides good thermal insulation. It is suitable for both hot and cold water pipes in residential and light commercial settings. Polyethylene foam insulation is available in tubular form with pre-slit sections for easy installation, and it can be sealed with adhesive or tape. Polyurethane foam offers high insulating value with a rigid structure and can be molded to fit complex shapes. It is used for underground pipes and situations requiring high insulation performance, applied as a spray foam or in pre-formed sections sealed around the pipe.

Reflective foil insulation reflects radiant heat and is often used in combination with other insulation materials for added efficiency. It is commonly used in high-temperature applications or where space constraints limit the use of thicker insulation. Reflective foil is wrapped around the pipe, often in conjunction with other insulating materials.

The methods of insulation include pre-formed tubular insulation, where sections made from materials like foam rubber, polyethylene foam, or fiberglass are slid over the tube, providing consistent insulation with a self-sealing adhesive strip. Wrap-around insulation involves wrapping the tube with insulating material, such as fiberglass or reflective foil, and securing it with insulation tape or wire, allowing for thicker insulation layers if needed. Spray foam insulation involves spraying polyurethane foam directly onto the tube, expanding and hardening to form a continuous insulating layer that provides excellent coverage and fills gaps and voids. Tube lagging involves wrapping the tube with insulating material and then covering it with a protective layer, such as a PVC jacket or metal cladding, providing additional protection against physical damage and weather. Insulation blankets, typically made from fiberglass, are wrapped around the tube and secured with bands or ties, offering flexibility and easy installation, suitable for large-diameter tube.

When insulating water tubes, additional considerations include the thickness of the insulation material, moisture resistance for cold water pipes to prevent condensation and potential mold growth, fire safety in high-temperature applications by using non-combustible materials like fiberglass, and UV resistance for outdoor tube to prevent degradation. By carefully selecting the appropriate materials and methods, water tubes can be effectively insulated to enhance energy efficiency, maintain temperature stability, and prolong the lifespan of the tube system.

Figure 10:
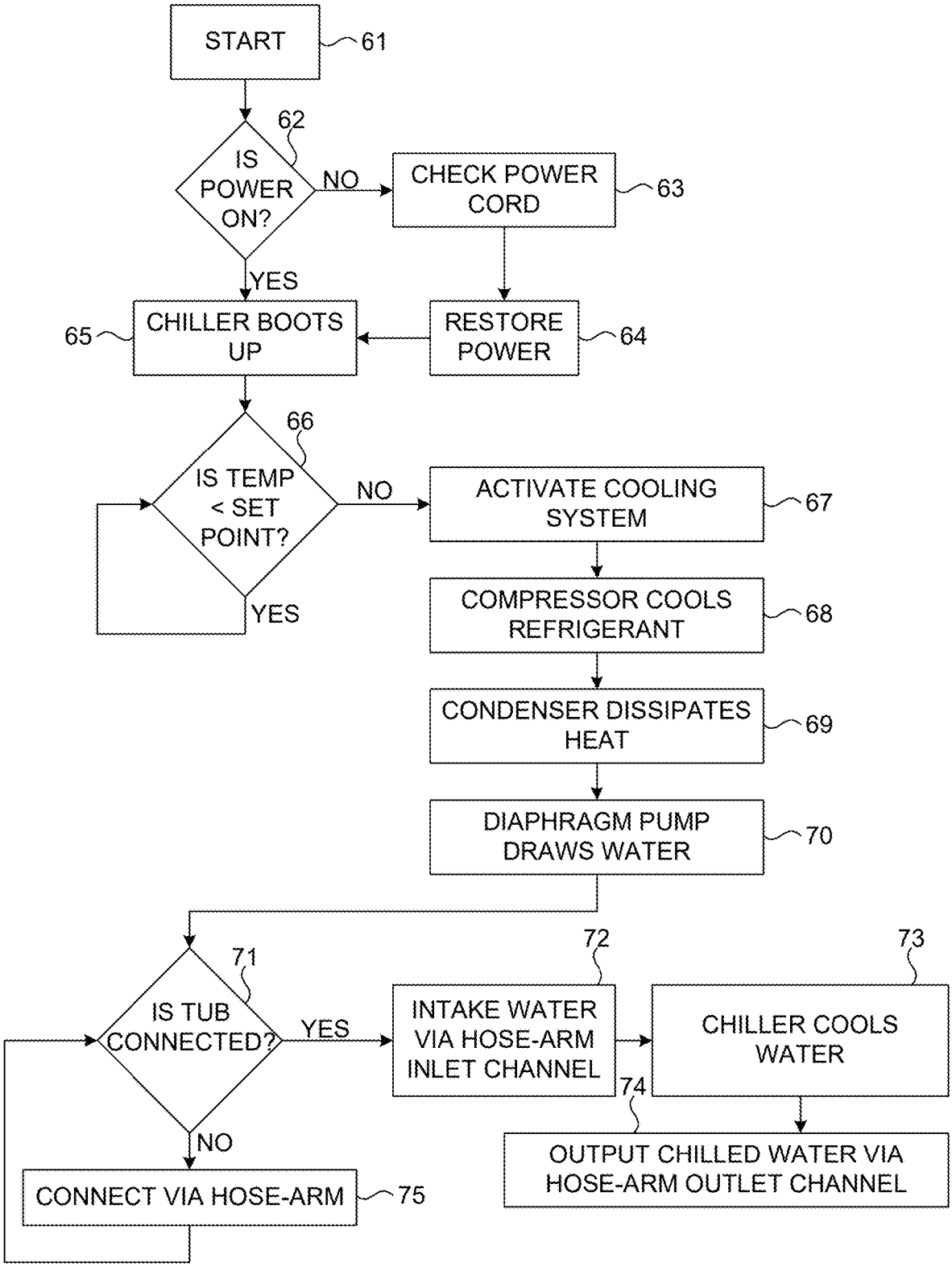
FIG. 10 is a flowchart diagram illustrating the operation of the home plunge system.

FIG. 10 is a flowchart diagram illustrating the operation of the home plunge system. In step 61, the process is started. In step 62, it is determined if the power is on. If the power is off, in step 63 the power cord connection is checked. In step 64, power is restored to the chiller. If the power is on, in step 65 the chiller boots up. In step 66 it is determined if the water temperature in the reservoir is below or equal to a temperature set point. If the water temperature is below or equal to the temperature set point, then the system waits. If the water temperature is above or equal to the temperature set point, then in step 67 the water cooling system is activated. In step 68 the compressor cools the refrigerant. In step 69 the condenser dissipates heat from the water. In step 70 the diaphragm pump draws water from the reservoir and pumps cooled water back into the reservoir. In step 71 it is determined that the hose-arm is connected to a reservoir, such as a bath tub. If the hose-arm is connected to the reservoir, then in step 72 water is transferred into the chiller from the reservoir via hose-arm inlet channel (e.g. inlet tube). In step 73, the chiller cools the inlet water. In step 74, the output chilled water is transferred to the reservoir via the outlet channel (e.g. outlet tube). If it is determined in step 71 that the reservoir is not connected then the hose-arm is connected to the reservoir in step 75.

Figure 11:
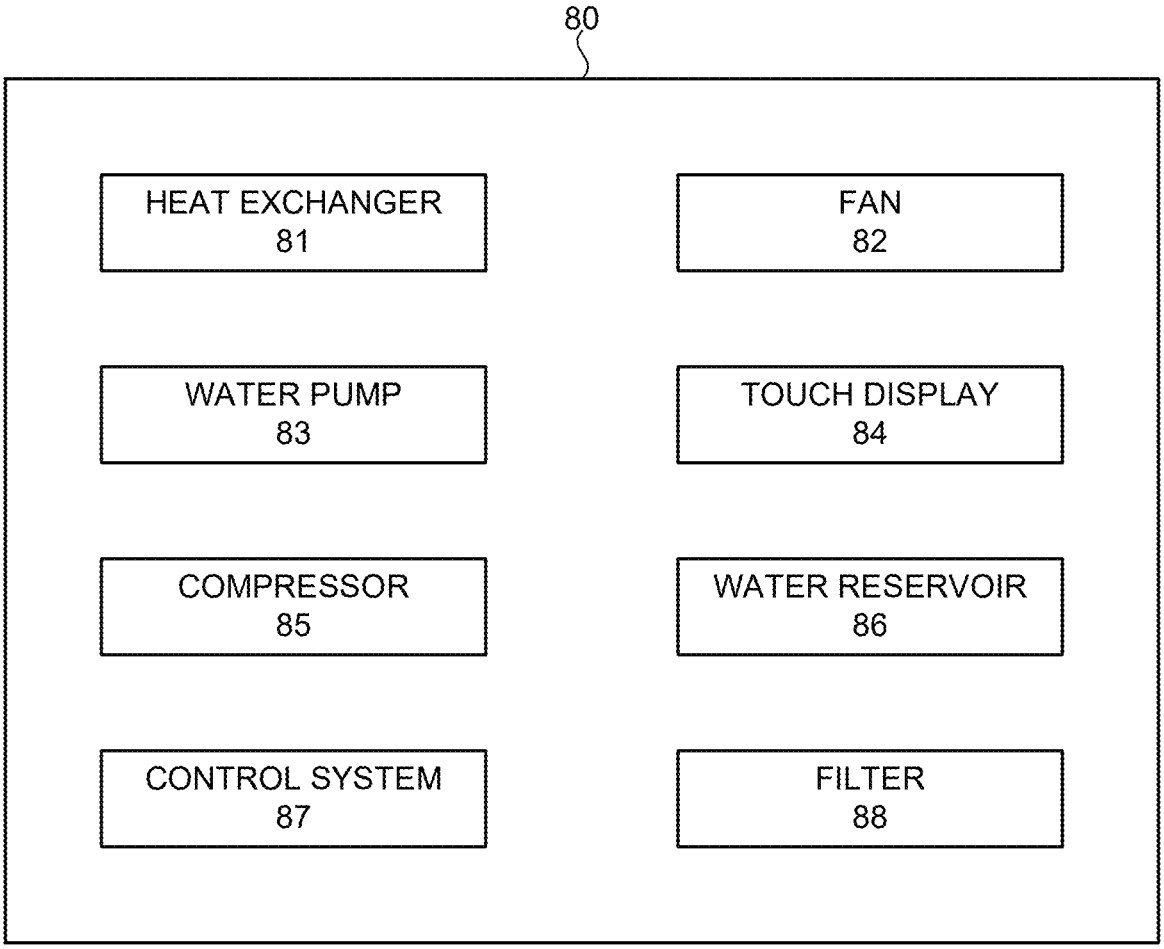
FIG. 11 is a system diagram of a chiller system.

FIG. 11 is a system diagram of the chiller system. The chiller system 80 includes multiple components such as, heat exchanger 81, fan 82, water pump 83, touch display 84, compressor 85, water reservoir 86, control system 87, and filter 88. In unison, these components operate to take water in from a reservoir, cool the water, and then pump the cooled water back into the reservoir.

A chiller system, such as the chiller system 80, operates through the coordinated efforts of several components to efficiently cool water and return it to a reservoir. The process begins with water being drawn from the water reservoir 86. This water first passes through the filter 88, which removes any impurities or debris, ensuring that only clean water enters the system. From the filter, the water is directed to the heat exchanger 81, a crucial component where the cooling process intensifies. Here, the heat exchanger facilitates the transfer of heat from the water to a refrigerant, thereby lowering the water's temperature.

To assist in dissipating the extracted heat, the fan 82 plays an essential role. It forces air over the heat exchanger, enhancing the removal of heat from the refrigerant and subsequently increasing the efficiency of the cooling process. The cooled water is then routed to the water pump 83, which is responsible for maintaining the necessary pressure and flow rate to move the water through the system and back into the reservoir.

The heart of the cooling mechanism is the compressor 85, which works by compressing the refrigerant, increasing its pressure and temperature. This high-temperature refrigerant is then passed through the condenser coil, where the fan 82 helps in dissipating the heat to the environment. After releasing its heat, the refrigerant cools down and returns to a liquid state before cycling back to the heat exchanger 81 to absorb more heat from the water.

Central to the operation of the chiller system is the control system 87, which integrates all the components and ensures they function harmoniously. It monitors various parameters, such as temperature, pressure, and flow rates, and adjusts the operation of the compressor, fan, and pump to optimize performance. The touch display 84 provides a user interface for monitoring system status, adjusting settings, and diagnosing issues.

In summary, the chiller system 80 operates through a sophisticated interplay of its components. Water is filtered, cooled via a heat exchanger with the aid of a fan, circulated by a pump, and continuously cycled back into the reservoir. The compressor and control system ensure the efficiency and reliability of the cooling process, while the touch display offers a user-friendly means to oversee and manage the system's operation.

Figure 12:
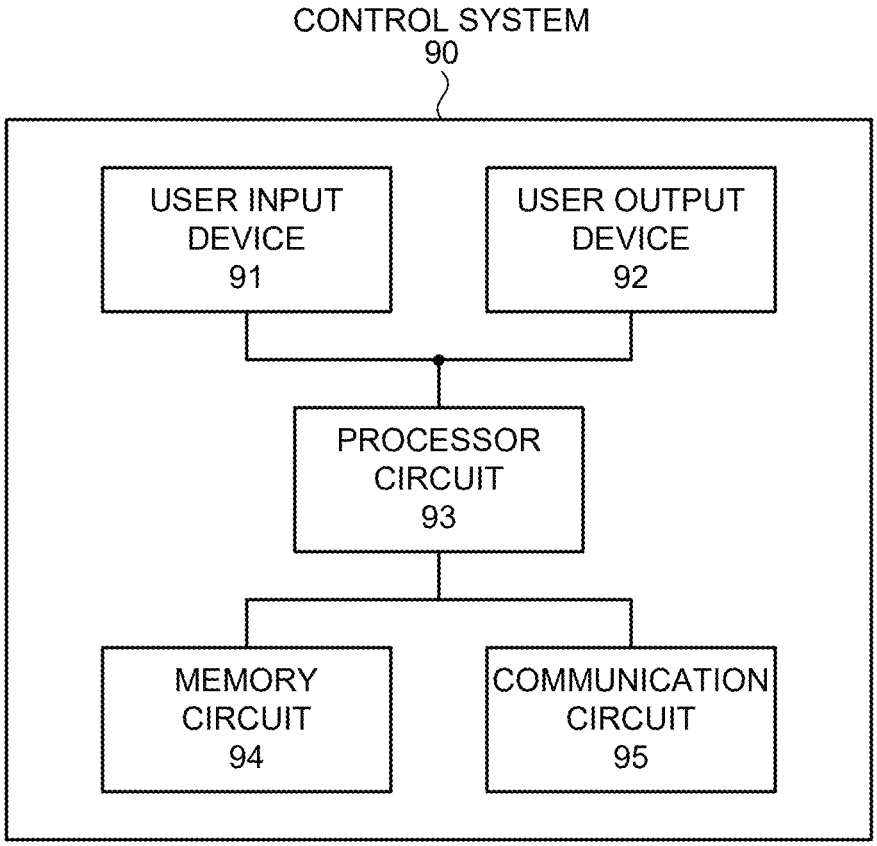
FIG. 12 is a system diagram of an electronic control system.

FIG. 12 is a system diagram of a control system. The control system 90 includes multiple components, such as, user input device 91 (keypad, touch screen, wireless input), a user output device 92 (screen, speaker, wireless output data), a processor circuit 93 capable of processing data and code/instructions, a memory circuit 94 configured to write and read data, and a communication circuit 95 configured to receive and/or transmit data to another device (e.g. mobile device or computer for remote setup, monitoring, and alerts). The control system 90 may further include one or more temperature sensors that detect the temperature of the water in the reservoir. The water temperature sensor is configured to communicate with processor circuit 93. In response to receiving information from the water temperature sensor, the software program being executed by the processor circuit 93 varies the operation of the home plunge system. In combination, these components operate to control the operation of the home plunge system and communicate with a user of the home plunge system.

There are several types of water temperature sensors, each with specific properties and applications.

Thermistors are temperature-sensitive resistors that come in two types: Negative Temperature Coefficient (NTC) and Positive Temperature Coefficient (PTC). NTC thermistors decrease in resistance as temperature increases, while PTC thermistors increase in resistance with rising temperature. These are widely used in household appliances like water heaters, refrigerators, and aquariums due to their sensitivity and accuracy over a limited temperature range.

Resistance Temperature Detectors (RTDs) are made from pure platinum, nickel, or copper, providing high precision and stability. RTDs operate on the principle that the resistance of metals increases with temperature, with the most common type being the platinum RTD (Pt100), where the resistance is 100 ohms at 0° C. RTDs are used in industrial processes, HVAC systems, and laboratory equipment due to their high accuracy and broad temperature range.

Thermocouples consist of two different metals joined at one end, creating a junction that generates a voltage related to temperature. The Seebeck effect governs thermocouples, where the voltage produced at the junction corresponds to the temperature difference between the junction and the reference point. Suitable for a wide range of temperatures, thermocouples are used in industrial processes, kilns, and engines.

Semiconductor temperature sensors, made from semiconductor materials, often come in integrated circuit (IC) form. They measure temperature by monitoring the voltage across a diode or transistor, which changes with temperature. These sensors are commonly used in electronic devices, consumer electronics, and environmental monitoring systems.

Water temperature sensors have several components, including the sensing element that interacts directly with the water to measure its temperature. This element could be a thermistor, RTD element, thermocouple junction, or semiconductor chip. The housing is a protective casing made of materials like stainless steel, plastic, or epoxy to shield the sensing element from water and other environmental factors, ensuring durability and reliability. Wiring and connectors are essential for transmitting the temperature signal from the sensing element to the processing unit, requiring high-quality materials for accurate and stable signal transmission. A signal conditioning circuit may include amplifiers, filters, and analog-to-digital converters to process the raw signal from the sensor and convert it into a readable format for the control system.

The working principle of water temperature sensors involves direct measurement, where the sensor is immersed in the water, and the sensing element measures the temperature change, converting it into an electrical signal proportional to the temperature. This raw signal is processed through the signal conditioning circuit to ensure accuracy and stability and is then transmitted to the control system, which uses the data to adjust heating or cooling mechanisms to maintain the desired water temperature.

Although certain specific embodiments are described above for instructional purposes, the teachings of this patent document have general applicability and are not limited to the specific embodiments described above. Accordingly, various modifications, adaptations, and combinations of various features of the described embodiments can be practiced without departing from the scope of the invention as set forth in the claims.

What is claimed is:

1. A cold plunge system, comprising:

a water cooling device, comprising:
- a heat exchanger;
- a compressor;
- a fan;
- a water reservoir;
- a filter;
- an internal pump; and
- a hose-arm connecting receptacle; and a hose-arm configured to transport water from an external reservoir to the water cooling device and to transport water from the water cooling device to the external reservoir, the hose-arm comprising:
- a first insulated water tube;
- a second insulated water tube;
- a bend and stay object maintaining the shape of the hose-arm; and
- a hose-arm connecting terminal configured to connect a first end of the hose-arm to the hose-arm connecting receptacle.

2. The cold plunge system of claim 1, wherein the bend and stay object is a loc-line tension arm.

3. The cold plunge system of claim 1, wherein the first water tube is covered at least in part by a neoprene material.

4. The cold plunge system of claim 1, wherein the first water tube is insulated utilizing a foam material.

5. The cold plunge system of claim 1, wherein the water cooling device includes a hose-arm receptacle configured to mate with the hose-arm connecting terminal.

6. The cold plunge system of claim 1, wherein the hose-arm connecting terminal is a quick connect terminal configured to release the hose-arm from the water cooling device when a quick release button is pressed.

7. The cold plunge system of claim 1, further comprising:

a hose-arm enclosure configured to enclose the first insulated water tube, the second insulated water tube, the bend and stay object, and the hose-arm connecting terminal.

8. The cold plunge system of claim 1, wherein the hose-arm enclosure is fabricated using a plastic material.

9. The cold plunge system of claim 1, wherein the hose-arm includes an outer sleeve.

10. The cold plunge system of claim 9, wherein the hose-arm outer sleeve is perforated.

11. The cold plunge system of claim 9, wherein the hose-arm sleeve is configured to be stretchable.

12. The cold plunge system of claim 1, wherein the external reservoir is a bathtub.

13. The cold plunge system of claim 1, wherein the hose-arm outer sleeve includes a nylon fabric.

14. The cold plunge system of claim 1, wherein the cold plunge system is configured to transport water from the external reservoir into the water cooling device and then to transport water from the water cooling device to the external reservoir.

15. The cold plunge system of claim 1, further comprising:

a controller circuit configured to control the water cooling device and the internal pump.

16. The cold plunge system of claim 15, further comprising:

a temperature sensor, wherein the temperature sensor is configured to communicate with the controller circuit.

17. The cold plunge system of claim 15, wherein the controller circuit includes one or more processor circuits and a memory circuit, and wherein the controller circuit is configured to execute code stored in the memory circuit.

18. The cold plunge system of claim 15, further comprising:

a user input device; and a human readable output device.

19. The cold plunge system of claim 18, wherein the user input device and the human readable output device are a touch screen device.

20. The cold plunge system of claim 15, wherein the controller circuit is configured to communicate with a remote computing device via a communication circuit.

21. The cold plunge system of claim 1, wherein the bend and stay object is a metal object.

22. The cold plunge system of claim 1, wherein the bend and stay object is the first insulated water tube.

* * * * *